US007784446B2

(12) United States Patent
Rumpf

(10) Patent No.: US 7,784,446 B2
(45) Date of Patent: Aug. 31, 2010

(54) CONVEYING DEVICE COMPRISING A FUEL PUMP

(75) Inventor: Bernd Rumpf, Nidderau-Windecken (DE)

(73) Assignee: Continental Automotive GmbH, Hannover (DE)

( * ) Notice: Subject to any disclaimer, the term of this patent is extended or adjusted under 35 U.S.C. 154(b) by 651 days.

(21) Appl. No.: 11/914,443

(22) PCT Filed: May 18, 2006

(86) PCT No.: PCT/EP2006/062404

§ 371 (c)(1),
(2), (4) Date: Nov. 14, 2007

(87) PCT Pub. No.: WO2006/122963

PCT Pub. Date: Nov. 23, 2006

(65) Prior Publication Data

US 2008/0276909 A1 Nov. 13, 2008

(30) Foreign Application Priority Data

May 19, 2005 (DE) ..... 10 2005 023 189

(51) Int. Cl.
*F02D 41/30* (2006.01)
*F02D 41/22* (2006.01)

(52) U.S. Cl. ..... 123/497; 417/44.1

(58) Field of Classification Search ..... 123/458, 123/497, 498; 701/102; 417/44.1
See application file for complete search history.

(56) References Cited

U.S. PATENT DOCUMENTS 4,756,291 A * 7/1988 Cummins et al. ..... 123/497
5,499,538 A 3/1996 Glidewell et al. ..... 73/119
5,505,180 A 4/1996 Otterman et al. ..... 123/497
5,715,797 A * 2/1998 Minagawa et al. ..... 123/497
6,213,100 B1 4/2001 Johansen ..... 123/509
6,453,878 B1 * 9/2002 Mazet ..... 123/497
6,609,501 B2 * 8/2003 Doane et al. ..... 123/458
6,715,470 B2 4/2004 Takahashi ..... 123/458
6,907,775 B2 6/2005 Hosoya ..... 73/119
6,935,317 B2 * 8/2005 Wiesenberger et al. ..... 701/114
2002/0148445 A1 * 10/2002 Doane et al. ..... 123/458
2003/0127082 A1 * 7/2003 Takahashi ..... 123/472
2004/0112126 A1 * 6/2004 Hosoya ..... 73/118.1

(Continued)

FOREIGN PATENT DOCUMENTS

DE 3840912 C2 4/2000

(Continued)

OTHER PUBLICATIONS

International Search Report PCT/EP2006/062404, 5 pages, Aug. 8, 2006.

*Primary Examiner*—Stephen K Cronin
*Assistant Examiner*—Arnold Castro
(74) *Attorney, Agent, or Firm*—King & Spalding L.L.P.

(57) ABSTRACT

A conveying device (1) has a fuel pump (5) for supplying an internal combustion engine (2) of a motor vehicle with fuel. The conveying device further has a monitoring apparatus (10) for determining the wear condition or the degree of soiling of the fuel pump (5). To this end, the monitoring apparatus (10) compares the power consumption to the hydraulic power of the fuel pump (5). A diagnostic display (11) is activated when a predefined value for the power consumption is exceeded.

20 Claims, 2 Drawing Sheets

U.S. PATENT DOCUMENTS

2004/0250611 A1* 12/2004 Rumpf ..... 73/119 A

FOREIGN PATENT DOCUMENTS

DE 10021054 A1 12/2000
DE 19948514 A1 4/2001
DE 10002613 A1 7/2001
DE 19617496 C2 6/2002
DE 10236654 A1 7/2003
DE 10357483 A1 7/2004
EP 0735260 A2 3/1996

* cited by examiner

CONVEYING DEVICE COMPRISING A FUEL PUMP

CROSS-REFERENCE TO RELATED APPLICATIONS

This application is a U.S. national stage application of International Application No. PCT/EP2006/062404 filed May 18, 2006, which designates the United States of America, and claims priority to German application number 10 2005 023 189.6 filed May 19, 2005, the contents of which are hereby incorporated by reference in their entirety.

TECHNICAL FIELD

The invention relates to a delivery device having a fuel pump for supplying an internal combustion engine of a motor vehicle with fuel, and having a device for supplying the fuel pump with electric current.

BACKGROUND

Such delivery devices are frequently used in contemporary automobiles and are therefore known. Contemporary fuel pumps will in future be regulated in a demand-dependent fashion according to the quantity of fuel required by the internal combustion engine. The device for supplying the fuel pump with electric current supplies a specified current and a specified voltage, if appropriate with a specified clock rate, to the fuel pump. However, fuel pumps are subject to natural wear during the service life and can additionally become soiled. This reduces the efficiency of the fuel pump, resulting in an increase in the consumption of electrical power for the same hydraulic power output of the fuel pump.

In order to compensate for a reduction in the hydraulic power output for the same consumption of electrical power of the fuel pump, a particularly high-power fuel pump is usually used. This avoids a decrease in the power of the internal combustion engine after wear or soiling of the fuel pump has occurred. However, using the particularly high-power fuel pump entails the disadvantage that as a result the delivery device has very large dimensions and is costly and as a result the consumption of current rises.

SUMMARY

The use of a particularly high-power fuel pump can be avoided, according to an embodiment, by a delivery device comprising a fuel pump for supplying an internal combustion engine of a motor vehicle with fuel, a device for supplying the fuel pump with electric current, and a monitoring device for monitoring the power consumption of the fuel pump for a specified hydraulic power output.

According to a further embodiment, the monitoring device can be arranged in a control unit which supplies the fuel pump with electric current. According to a further embodiment, the control unit can be connected to an engine control unit of the internal combustion engine which determines the required quantity of fuel. According to a further embodiment, the control unit may have a memory for a fuel pump characteristic curve of the power consumption of the fuel pump as a function of the quantity of fuel which is required by the internal combustion engine and is to be delivered. According to a further embodiment, the control unit can be designed to determine the deviation of the power consumption of the fuel pump necessary for a required quantity of fuel to be delivered from the stored fuel pump characteristic curve. According to a further embodiment, in order to transfer a deviation of the power consumption with the stored fuel pump characteristic curve, the control unit may be connected to a diagnostic display and/or a diagnostic socket. According to a further embodiment, the control unit can be arranged inside the delivery device, in particular, in a flange which is to be inserted into the fuel container.

BRIEF DESCRIPTION OF THE DRAWINGS

The invention permits numerous embodiments. For further clarification of its basic principle, one of said embodiments is illustrated in the drawing and will be described below. In said drawing.

DETAILED DESCRIPTION

Figure 1:
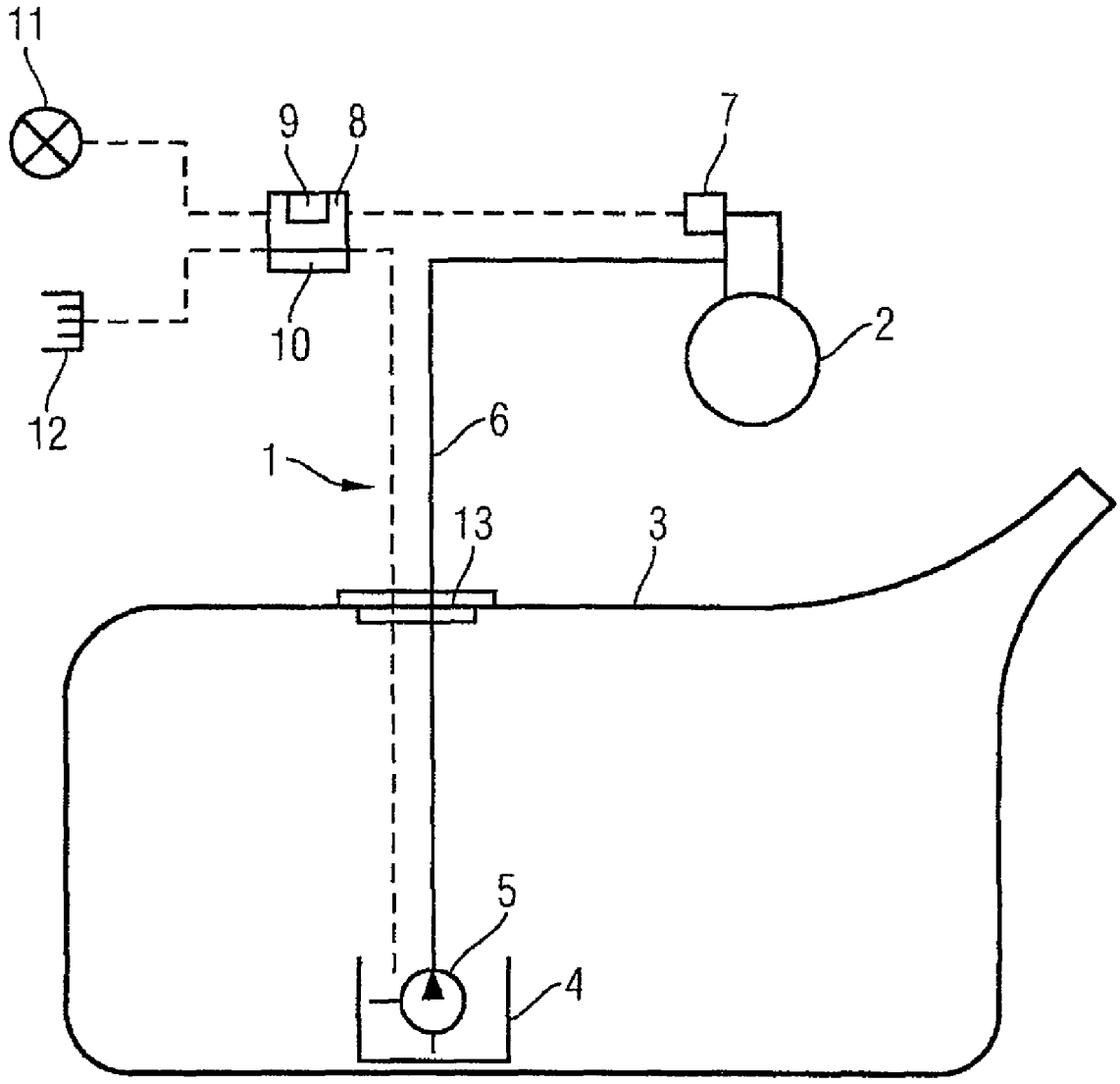
FIG. 1 is a schematic view of a delivery device according to an embodiment for supplying an internal combustion engine of a motor vehicle with fuel.

A configuration according to an embodiment makes it possible to register the gradually decreasing hydraulic power for a specified power consumption level of the fuel pump over the service life or when soiling occurs. Monitoring the power consumption of the fuel pump therefore ensures that the hydraulic power output which is reduced by wear or soiling is easily registered. According to an embodiment, it is therefore possible to use a fuel pump which is necessary for the specified hydraulic power output and to clean it or exchange it when wear or soiling occurs. Therefore, the delivery device according to an embodiment does not require a particularly high-power fuel pump. A particular advantage of the delivery device according to embodiment is that, for example, when there is a decrease in the power of the internal combustion engine, the fault can be limited in a particularly easy way. Thanks to the monitoring device, it is possible to determine whether the decrease in power has been caused, for example, by the fuel pump becoming soiled and/or experiencing wear.

The delivery device according to embodiment is a particularly simple structural design if the monitoring device is arranged in a control unit which supplies the fuel pump with electric current. In addition, as a result, the delivery device according to embodiment has a particularly low number of components.

In fuel pumps which are regulated according to demand, the comparison between the power consumption and the hydraulic power which is output can be easily made in accordance with another embodiment if the control unit is connected to an engine control unit of the internal combustion engine which determines the required quantity of fuel. Since the engine control unit determines the quantity of fuel required by the internal combustion engine in any case, it can transfer this required quantity to the control unit which supplies the fuel pump with electric current. The control unit subsequently supplies the fuel pump with sufficient current and voltage until the requirement of the engine control unit is covered. The comparison of the currently supplied current or voltage with corresponding values from the as new state of the fuel pump is a measure of the current wear of the fuel pump.

According to another embodiment, the current wear or the soiling of the fuel pump can be determined in every operating state of the fuel pump if the control unit has a memory for a fuel pump characteristic curve of the power consumption of the fuel pump as a function of the quantity of fuel which is required by the internal combustion engine and is to be delivered.

According to another embodiment, the determination of the current wear of the fuel pump requires particularly low structural expenditure if the control unit is designed to determine the deviation of the power consumption of the fuel pump necessary for the required quantity of fuel to be delivered from the stored fuel pump characteristic curve. This configuration permits the wear or the soiling of the fuel pump to be already registered before the quantity of fuel required by the internal combustion engine can no longer be covered by the fuel pump under full load. The determined deviation of the current power consumption with the stored fuel pump characteristic curve is preferably stored and can be read out within the scope of an engine test.

According to another embodiment, the immediate signaling of the fact that the wear limit or the permissible degree of soiling of the fuel pump has been reached can be generated easily if, in order to transfer the deviation of the power consumption with the stored fuel pump characteristic curve, the control unit is connected to a diagnostic display and/or a diagnostic socket.

The delivery device according to embodiment is particularly easy to mount if the control unit is arranged inside the delivery device, preferably in a flange which is to be inserted into the fuel container.

FIG. 1 is a schematic view of a delivery device 1 for supplying an internal combustion engine 2 of a motor vehicle with fuel from a fuel container 3. The delivery device 1 has a fuel pump 5 which is arranged in a splash pot 4. The splash pot 4 is prestressed against the floor of the fuel container 3. The fuel pump 5 delivers the fuel from the splash pot 4 to the internal combustion engine 2 via a forward feed line 6. An engine control unit 7 determines the quantity of fuel required by the internal combustion engine 2 as a function of the operating state of the motor vehicle, and said engine control unit 7 is connected to a control unit 8 which supplies the fuel pump 5 with electric current. The control unit 8 has a memory 9 for a fuel pump characteristic curve. The fuel pump characteristic curve indicates the power consumption of the fuel pump 5 for the quantity of fuel to be delivered. Since the quantity of fuel to be delivered corresponds to the quantity of fuel required by the internal combustion engine 2, the control unit 8 determines the necessary voltage or the necessary current for the fuel pump 5 from the fuel pump characteristic curve. Furthermore, the control unit 8 has a monitoring device 10 with which a comparison is made in order to determine whether the power consumption of the fuel pump 5 is sufficient to deliver the necessary quantity of fuel. The control unit 8 is additionally connected to a diagnostic display 11, which has for example a monitoring lamp on a dashboard of the motor vehicle, and to a diagnostic socket 12. The values of the monitoring device 10 and the state of wear or state of soiling of the fuel pump 5 can be read out via the diagnostic socket 12 using a corresponding diagnostic unit (not illustrated).

In an alternative embodiment (not illustrated), the control unit 8 can be arranged in a flange 13 which is to be inserted into the fuel container 3.

Figure 2:
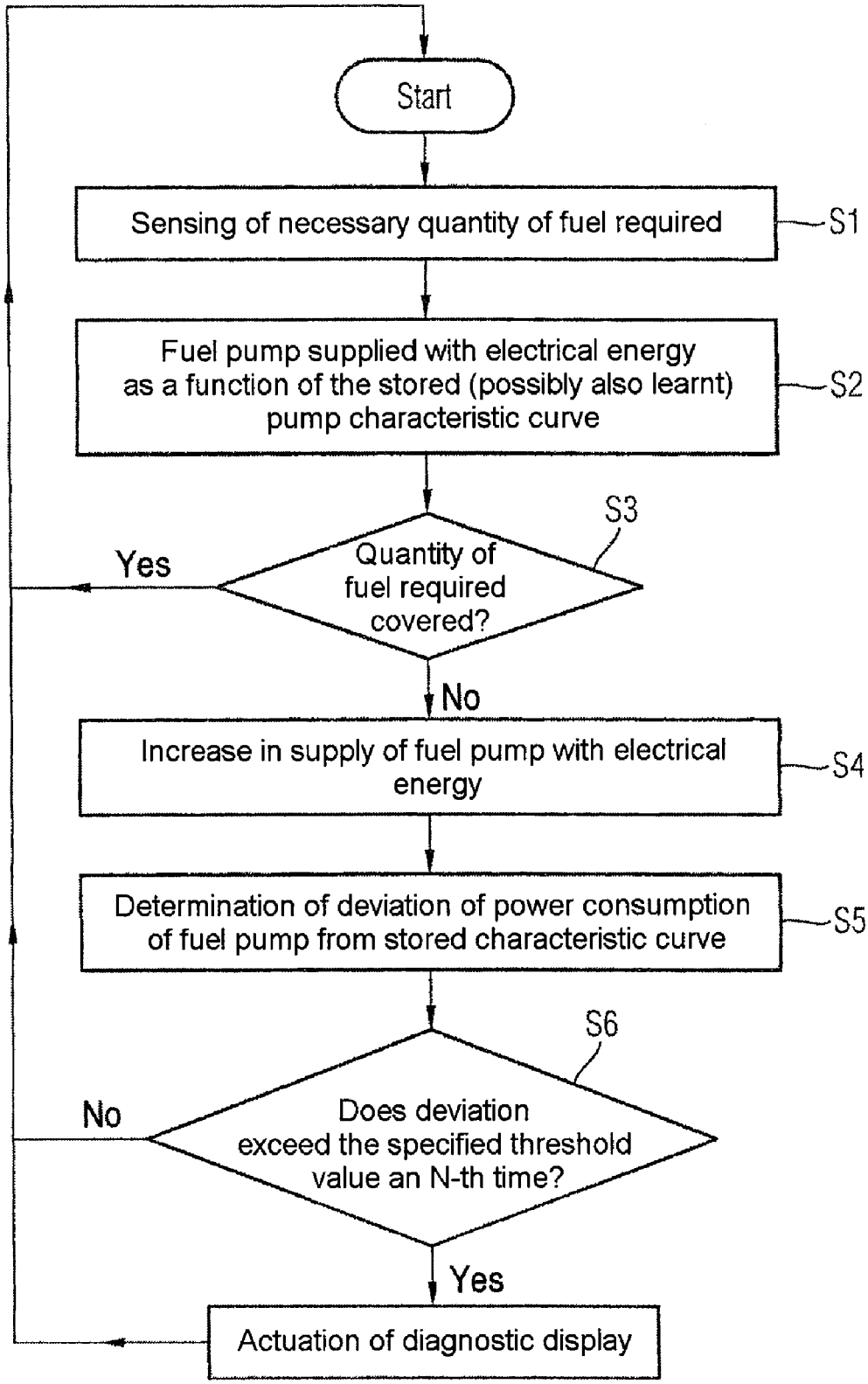
FIG. 2 is a flowchart relating to the monitoring of the power consumption of a fuel pump of the delivery device according to the embodiment from FIG. 1.

FIG. 2 shows a flowchart relating to the actuation and monitoring of the fuel pump 5 from FIG. 1. In a first step S1, the engine control unit 7 determines the quantity of fuel required by the internal combustion engine 2 and transfers the quantity of fuel required to the control unit 8. The control unit 8 determines the power consumption of the fuel pump 5 in a step S2 by reference to a stored or learnt fuel pump characteristic curve and the quantity of fuel required, and said control unit 8 supplies the fuel pump 5 with electric current, the electrical voltage or current pulses in accordance with the specified power consumption. In a step S3, it is sensed whether the fuel required by the internal combustion engine 2 is covered. If this is the case, the control unit 8 waits for a change in the requirement by the engine control unit 7. If the quantity of fuel required by the internal combustion engine 2 is not covered, the supply of electric current to the fuel pump 5 is increased in a step S4. At the same time, in a step S5 the deviation of the power consumption of the fuel pump 5 from the fuel pump characteristic curve is determined by the monitoring device 10. The determined deviation is a measure of the wear or the soiling of the fuel pump 5. In a step S6, a comparison is made to determine whether the deviation exceeds a specified threshold value. If this is the case, the diagnostic display 11 is activated and a message, which can be read out via the diagnostic socket 12, is stored. If the specified threshold value is not exceeded, the control unit 8 waits again for a change in the requirement by the engine control unit 7.

What is claimed is:

1. A delivery device comprising:

a fuel pump for supplying an internal combustion engine of a motor vehicle with fuel, a device for supplying the fuel pump with electric current, and a monitoring device for:

monitoring the power consumption of the fuel pump for a specified hydraulic power output, determining a deviation between the monitored power consumption of the fuel pump and a predetermined power consumption for a required quantity of fuel, determining whether the deviation between the monitored power consumption and the predetermined power consumption exceeds a threshold value, and if the deviation between the monitored power consumption and the predetermined power consumption exceeds the threshold value, generating a user notification.

2. The delivery device according to claim 1, wherein the monitoring device is arranged in a control unit which supplies the fuel pump with electric current.

3. The delivery device according to claim 1, wherein the control unit is connected to an engine control unit of the internal combustion engine which determines the required quantity of fuel.

4. The delivery device according to claim 1, further comprising a memory for a fuel pump characteristic curve of the power consumption of the fuel pump as a function of the quantity of fuel which is required by the internal combustion engine and is to be delivered.

5. The delivery device according to claim 4, wherein the predetermined power consumption is determined from the stored fuel pump characteristic curve.

6. The delivery device according to claim 1, wherein the monitoring device is further configured to send the notification that the deviation exceeds the threshold value to a diagnostic display and/or a diagnostic socket.

7. The delivery device according to claim 1, wherein the control unit is arranged inside the delivery device.

8. The delivery device according to claim 7, wherein the control unit is arranged in a flange which is to be inserted into the fuel container.

9. A method for supplying an internal combustion engine of a motor vehicle with fuel, the method comprising:

supplying a fuel pump with electric current, monitoring the power consumption of the fuel pump for a specified hydraulic power output, determining a deviation between the monitored power consumption of the fuel pump and a predetermined power consumption for a required quantity of fuel, determining whether the deviation between the monitored power consumption and the predetermined power consumption exceeds a threshold value, and if the deviation between the monitored power consumption and the predetermined power consumption exceeds the threshold value, generating a user notification.

10. The method according to claim 9, wherein the step of monitoring is performed by a monitoring device arranged in a control unit which supplies the fuel pump with electric current.

11. The method according to claim 9, further comprising the step of determining the required quantity of fuel by an engine control unit of the internal combustion engine which is connected to a control unit.

12. The method according to claim 9, further comprising storing a fuel pump characteristic curve of the power consumption of the fuel pump in a memory as a function of the quantity of fuel which is required by the internal combustion engine and is to be delivered.

13. The method according to claim 12, wherein the predetermined power consumption is determined from the stored fuel pump characteristic curve.

14. The method according to claim 9, comprising the step of sending the notification that the deviation exceeds the threshold value to a diagnostic display and/or a diagnostic socket.

15. A delivery device comprising:

a fuel pump for supplying an internal combustion engine of a motor vehicle with fuel, a device for supplying the fuel pump with electric current, and a monitoring device for:

monitoring the power consumption of the fuel pump for a specified hydraulic power output, determining a deviation between the monitored power consumption of the fuel pump and a predetermined power consumption for a required quantity of fuel, determining whether the deviation between the monitored power consumption and the predetermined power consumption exceeds a threshold value, and if the deviation between the monitored power consumption and the predetermined power consumption exceeds the threshold value, generating a user notification, wherein the monitoring device is arranged in a control unit which supplies the fuel pump with electric current and the control unit is connected to an engine control unit of the internal combustion engine which determines the required quantity of fuel.

16. The delivery device according to claim 15, further comprising a memory for a fuel pump characteristic curve of the power consumption of the fuel pump as a function of the quantity of fuel which is required by the internal combustion engine and is to be delivered.

17. The delivery device according to claim 16, wherein the predetermined power consumption is determined from the stored fuel pump characteristic curve.

18. The delivery device according to claim 15, wherein the monitoring device is further configured to send the notification that the deviation exceeds the threshold value to a diagnostic display and/or a diagnostic socket.

19. The delivery device according to claim 15, wherein the control unit is arranged inside the delivery device.

20. The delivery device according to claim 19, wherein the control unit is arranged in a flange which is to be inserted into the fuel container.

* * * * *